US009464866B1

(12) United States Patent
Liang et al.

(10) Patent No.: US 9,464,866 B1
(45) Date of Patent: Oct. 11, 2016

(54) TOY GUN ASSEMBLY STRUCTURE

(71) Applicant: VEGA FORCE INTERNATIONAL CORP., New Taipei (TW)

(72) Inventors: Hsin-Ting Liang, New Taipei (TW); Shih-Che Kung, New Taipei (TW)

(73) Assignee: VEGA FORCE INTERNATIONAL CORP., New Taipei (TW)

( * ) Notice: Subject to any disclaimer, the term of this patent is extended or adjusted under 35 U.S.C. 154(b) by 0 days.

(21) Appl. No.: 14/885,558

(22) Filed: Oct. 16, 2015

(51) Int. Cl.

| | |
|---|---|
| ***F41B 11/00*** | (2013.01) |
| ***F41A 21/48*** | (2006.01) |
| ***F41C 23/16*** | (2006.01) |
| ***F41A 21/20*** | (2006.01) |
| ***F41C 23/18*** | (2006.01) |

(52) U.S. Cl.
CPC ..... *F41C 23/16* (2013.01); *F41A 21/20* (2013.01); *F41C 23/18* (2013.01)

(58) Field of Classification Search
CPC ..... F41A 21/00; F41A 21/16; F41A 21/48; F41A 21/485; F41A 21/487; F41B 7/003; F41B 7/08; F41B 11/00; F41B 11/70
See application file for complete search history.

(56) References Cited

U.S. PATENT DOCUMENTS

| | | | | |
|---|---|---|---|---|
| 6,655,372 | B1 * | 12/2003 | Field | F41B 11/00 124/83 |
| 6,698,128 | B2 * | 3/2004 | Kessler | F41B 11/00 124/83 |
| 7,891,130 | B2 * | 2/2011 | Griffin | F41C 27/06 42/105 |
| 7,905,041 | B1 * | 3/2011 | Davies | F41A 3/66 42/75.02 |
| 8,205,373 | B1 * | 6/2012 | Ubl | F41C 23/16 42/71.01 |
| 8,714,146 | B2 * | 5/2014 | Hu | F41A 21/12 124/83 |
| 8,776,771 | B1 * | 7/2014 | Yang | F42B 12/40 124/71 |
| 8,782,943 | B2 * | 7/2014 | Jarboe | F41A 21/485 42/75.02 |
| 9,003,686 | B2 * | 4/2015 | Brown | F41C 23/16 42/75.01 |
| 2008/0295818 | A1 * | 12/2008 | Styles | F41A 21/48 124/83 |
| 2010/0319231 | A1 * | 12/2010 | Stone | F41C 23/16 42/71.01 |

* cited by examiner

*Primary Examiner* — John Ricci
(74) *Attorney, Agent, or Firm* — Chun-Ming Shih; HDLS IPR Services

(57) ABSTRACT

A toy gun assembly structure includes a gun frame, a hand guard sleeve, a gun barrel and a hand guard. The hand guard sleeve connected to the gun frame includes an inner insertion portion and an outer mounting portion. One end of the hand guard sleeve faces toward another end to define an axial direction. The inner insertion portion and the outer mounting portion respectively include first and second guiding members along the axial direction. The gun barrel is inserted into the inner insertion position. An outer perimeter of the gun barrel includes first corresponding guiding members slidably attached to the first guiding members correspondingly. The hand guard is mounted onto the outer mounting portion. An inner perimeter of the hand guard includes second corresponding guiding members slidably attached to the second guiding members correspondingly. Therefore, easy assembling and time saving for the gun assembly structure can be achieved.

12 Claims, 6 Drawing Sheets

TOY GUN ASSEMBLY STRUCTURE

BACKGROUND OF THE INVENTION

1. Field of the Invention

The present invention is related to a toy gun, in particular, to a toy gun assembly structure having the effect of facilitated assembly.

2. Description of Related Art

Currently, a toy gun typically includes at least the structural members of a gun frame, a gun barrel and a hand guard and so on, and it involves a tedious assembly process for completely assembling the toy gun for uses; therefore, its assembly is of the drawbacks of time-consuming and tedious labor.

Furthermore, most toy guns are made of a metal material such that their costs are relatively high and sales prices also remain high such that they are not widely accepted by users, which has been a problem troubling the developer and manufacturers for a long time.

Therefore, the inventor of the present invention seeks to provide an improvement capable of overcoming the aforementioned drawbacks.

SUMMARY OF THE INVENTION

A first objective of the present invention is to provide a toy gun assembly structure such that it is of the effects of facilitated assembly and time-saving assembly.

A second objective of the present invention is to provide a toy gun assembly structure such that it is of the merits of reduced cost and reduced sales price in order to increase the acceptance and availability of the toy gun.

A third objective of the present invention is to provide a toy gun assembly structure such that it is of the effect of reducing the loading of the user while maintaining its structural strength competent to a toy gun made of a metal material.

To achieve the aforementioned objectives, the present invention provides a toy gun assembly structure, comprising: a gun frame; a hand guard sleeve connected to the gun frame and having an inner insertion portion and an outer mounting portion, one end of the hand guard sleeve facing toward a direction of another end opposite from the one end to define an axial direction, the inner insertion portion and the outer mounting portion respectively comprising a plurality of first guiding members and a plurality of second guiding members extended along the axial direction; a gun barrel inserted into the inner insertion position correspondingly, an outer perimeter of the gun barrel having a plurality of first corresponding guiding members disposed thereon and slidably attached to each one of the first guiding members correspondingly; and a hand guard correspondingly mounted onto the outer mounting portion, an inner perimeter of the hand guard having a plurality of second corresponding guiding members disposed thereon and slidably attached to each one of the second guiding members correspondingly.

According to the toy gun assembly structure of the present invention, wherein the gun frame, the hand guard sleeve, the gun barrel and the hand guard are all made of an industrial plastic material.

In comparison to the prior arts, the present invention includes the following effects and merits: the present invention allows the gun barrel and the hand guard to be assembled onto the gun frame via the hand guard sleeve such that the effects of facilitated assembly and time-saving assembly can be achieved. Furthermore, the present invention uses an industrial plastic material for the gun frame, the hand guard sleeve, the gun barrel and hand guard such that the merits of reduced cost and reduced sales price can be achieved in order to increase the acceptance and availability of the toy dun in addition to that the present invention is of a light-weight structure while maintaining a structural strength competent to a typical toy gun made of a metal.

DETAILED DESCRIPTION OF THE INVENTION

The following provides a detailed description on the embodiments and technical content related to the present invention along with the accompanied drawings. However, it shall be understood that the accompanied drawings are provided for illustration purposes only and shall not be treated as limitations of the present invention.

Figure 1:
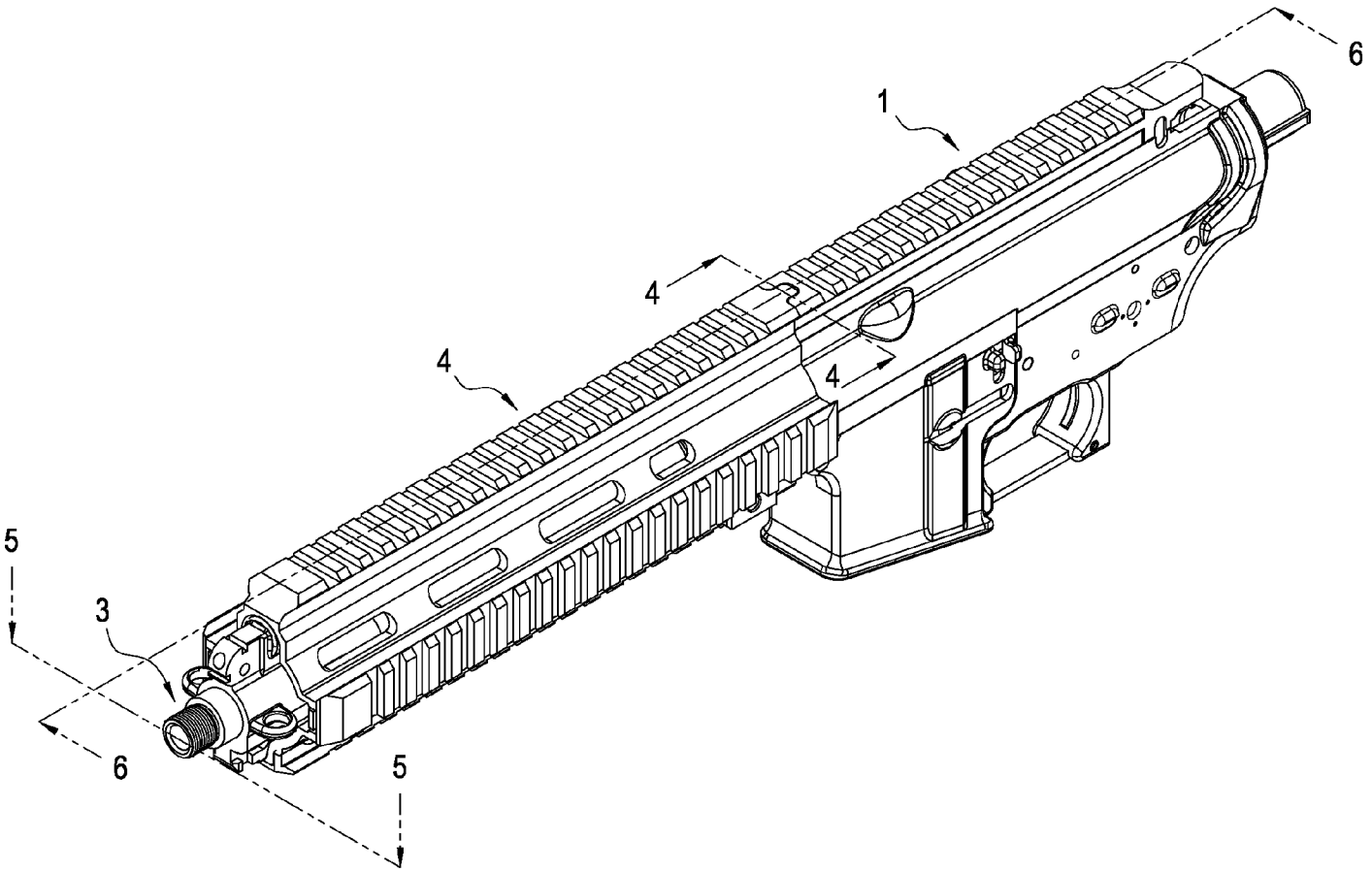
FIG. 1 is a perspective assembly view of the present invention.
Figure 2:
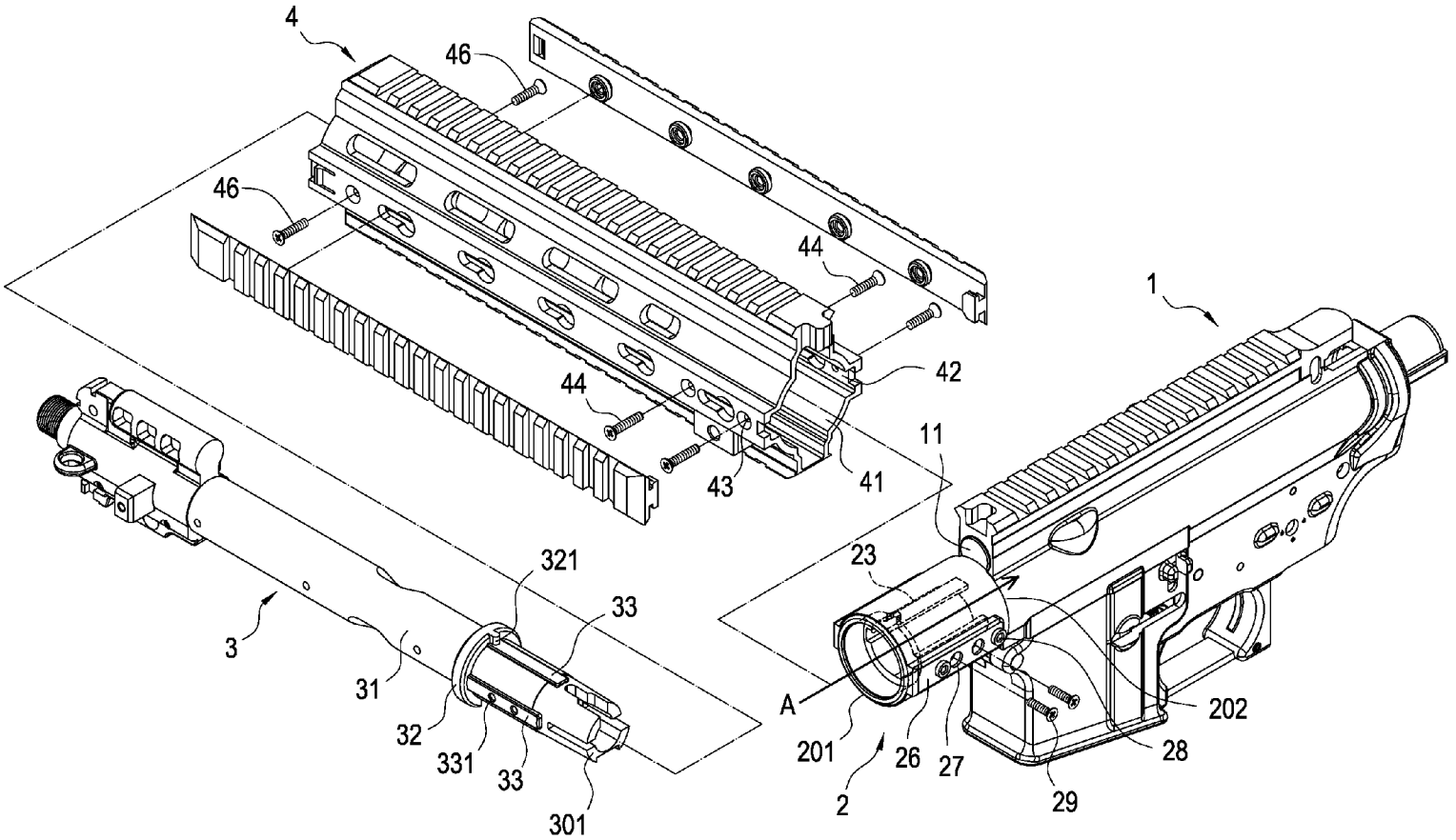
FIG. 2 is a perspective exploded view of the present invention.
Figure 3:
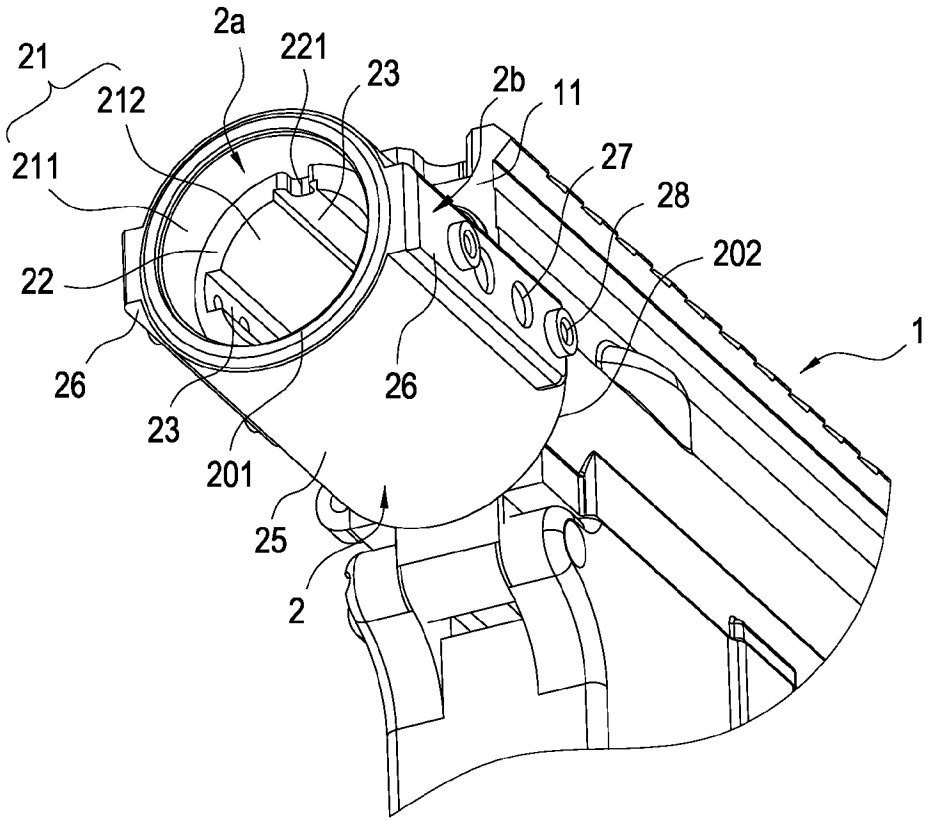
FIG. 3 is a perspective view of the hand guard sleeve of the present invention viewed from a different angle.

As shown in FIG. 1, FIG. 2 and FIG. 3, the present invention provides a toy gun assembly structure comprising: a gun frame 1, a hand guard sleeve 2, a gun barrel 3 and a hand guard 4.

The hand guard sleeve 2 is connected to (preferably integrally formed) a front end 11 of the gun frame 1 and allows the hand guard sleeve 2 to be fluidly connected to the front end 11 of the gun frame 1. In addition, the hand guard sleeve 2 includes an inner insertion portion 2*a* and an outer mounting portion 2*b*.

Wherein, the hand guard sleeve 2 includes one end 201 and another end 202 opposite from each other. The direction from the one end 201 toward the another end 202 is defined to be an axial direction A.

The insertion portion 2*a* comprises a plurality of first guiding members 23 extended along the axial direction A, and each one of the first guiding members 23 extends at an inner perimeter 21 of the hand guard sleeve 2.

The outer mounting portion 2*b* comprises a plurality of second guiding members 26 extended along the axial direction A, and each one of the second guiding members 26 extends at an outer perimeter 25 of the hand guard sleeve 2.

In this embodiment, the inner insertion portion 2*a* and the outer mounting portion 2*b* of the hand guard sleeve 2 are described in detail based on the examples provided in the following.

The inner perimeter 21 of the hand guard sleeve 2 comprises a first inner perimeter 211 and a second inner perimeter 212 protruding out of the first inner perimeter 211 in order to allow a stepped height drop portion 22 to form between one end of the first inner perimeter 211 and one end of the second inner perimeter 212.

Accordingly, each one of the first guiding members 23 is a guiding slot (i.e.: the first guiding member 23 of the guiding slot type) formed at the second inner perimeter 212, and each one of the second guiding member 26 is a rib (i.e.: the second guiding member 26 of the rib type) protruding out of the outer perimeter 25. Furthermore, the stepped height drop portion 22 includes a notch 221 indented toward the axial direction A and corresponding to one of the first guiding members 23.

The gun barrel 3 is inserted into a location corresponding to the inner insertion portion 2*a*. The outer perimeter 31 of the gun barrel 3 adjacent to an inner end 301 thereof includes a plurality of first corresponding guiding members 33 circumferentially formed thereon, and each one of the first corresponding guiding members 33 is slidably attached to each one of the first guiding members 23 correspondingly. Preferably, the first guiding member 23 and the first corresponding guiding member 33 are configured to include three members respectively in order to achieve the effect of fool-proof.

In this embodiment, each one of the first corresponding guiding members 33 of the gun barrel 3 is described in detail based on the examples provided in the following: each one of the first corresponding guiding members 33 is a plurality of ribs (i.e.: the first corresponding guiding member 33 of the rib type) protruded out of the outer perimeter 31 of the gun barrel 3 in order to allow each one of the first corresponding guiding members 33 of the rib type to be slidably attached to each one of the first guiding members 23 of the guiding slot type correspondingly.

In addition, each one of the ribs slides from an open end (corresponding to one end 201 of the hand guard sleeve 2) of the guiding slot to reach a close end (corresponding to another end 202 of the hand guard sleeve 2) of the guiding slot along the axial direction A. In this embodiment, the example in which the outer perimeter 31 of the gun barrel 3 includes a blocking portion 32 protruded therefrom is used for illustration such that it allows the blocking portion 32 of the gun barrel 3 can be blocked at the stepped height drop portion 22 correspondingly in order to achieve the effect of precise positioning on the axial direction A. Furthermore, with the cooperation of the guidance, similar to a guiding track, between the first corresponding guiding member 33 and the first guiding member 23, the effect of precision positioning rotational angle can be achieved.

Preferably, the blocking portion 32 includes a restricting member 321 formed corresponding to a location of one of the first corresponding guiding members 33 and toward the axial direction A. In addition, the restricting member 321 corresponds to the aforementioned notch 221 in order to allow the restricting member 321 to be inserted into a location corresponding to the notch 221 via a press-fit method such that there is no loose space in order to prevent the gun barrel 3 from rotating relative to the hand guard sleeve 2 and to achieve a greater assembly precision.

The hand guard 4 is mounted onto the outer mounting portion 2*b* correspondingly. An inner perimeter 41 of one end (opposite from the front end 11 of the gun frame 1) of the hand guard 4 includes a plurality of second corresponding guiding members 42 formed thereon. Each one of the second corresponding guiding members 42 is slidably attached to each one of the second guiding members 26 correspondingly.

In this embodiment, each one of the second corresponding guiding members 42 of the hand guard 4 is described in detail based on the examples provided in the following: each one of the second corresponding guiding members 42 is a plurality of guiding slots (i.e.: the second corresponding guiding member 42 of the guiding slot type) formed (or formed to indent thereon) at an inner perimeter 41 in order to allow each one of the second guiding members 26 of the rib type to slidably attach to a location of each one of the second corresponding guiding member 42 of the guiding slot type correspondingly.

Figure 6:
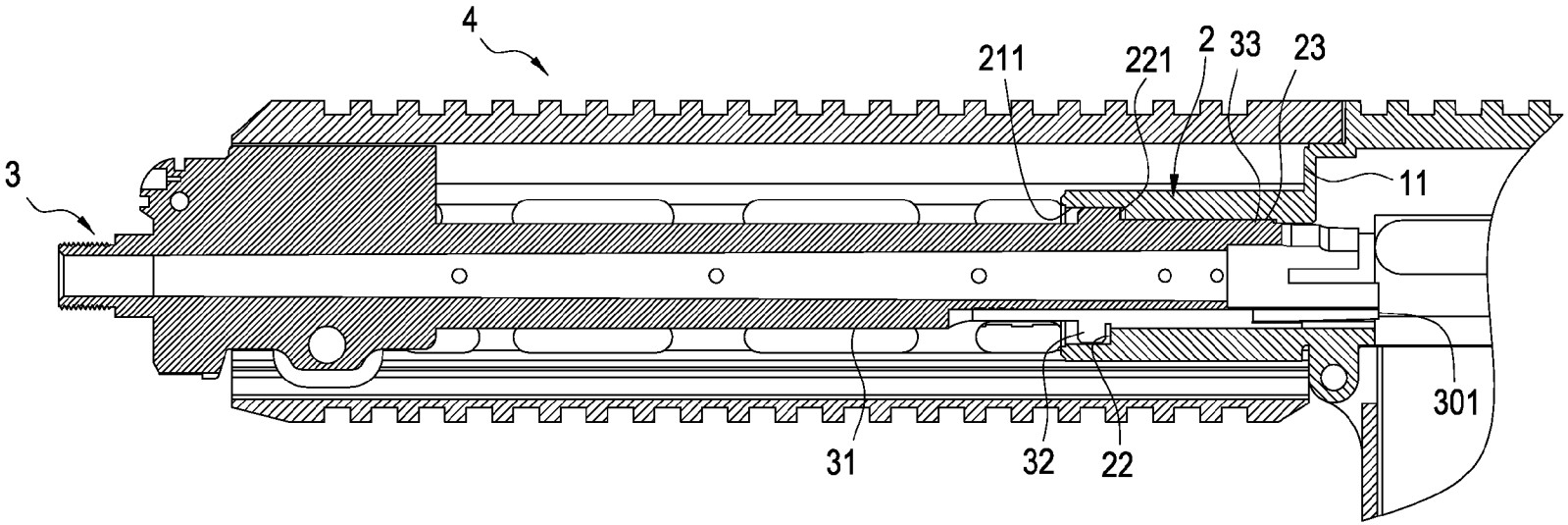
FIG. 6 is a cross sectional view of the present invention based on line 6-6 in FIG. 1.

Furthermore, one end of the hand guard 4 is able to abut against the front end 11 of the gun frame 1 for blocking and stopping purposes (as shown in FIG. 6) in order to achieve the effect of precision positioning on the axial direction A. In addition, with the cooperation of the guidance, similar to a guiding track, between the second guiding member 26 and the second corresponding guiding member 42, the effect of precision positioning rotational angle can be achieved.

Figure 4:
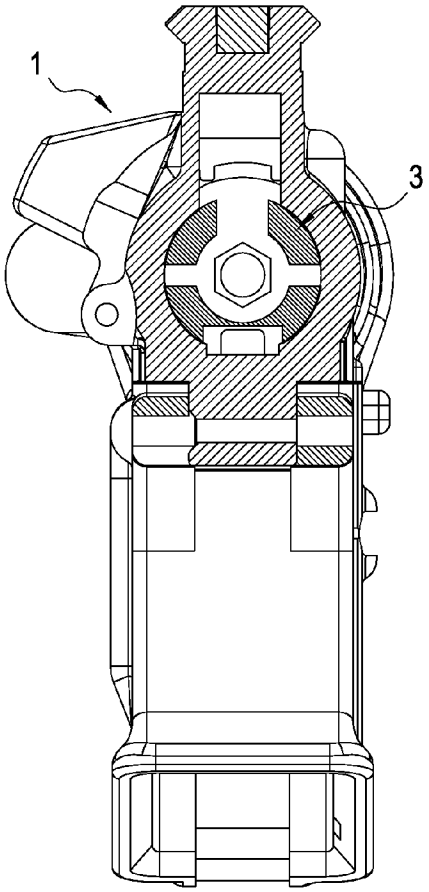
FIG. 4 is a cross sectional view of the present invention based on line 4-4 in FIG. 1.
Figure 5:
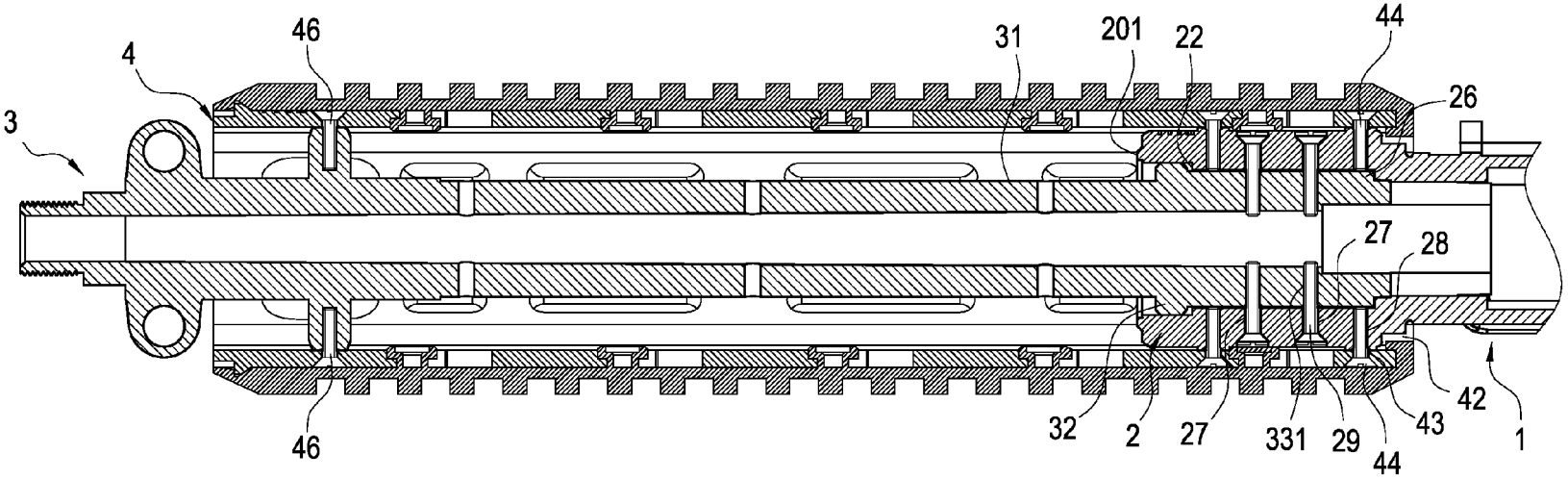
FIG. 5 is a cross sectional view of the present invention based on line 5-5 in FIG. 1.

As shown in FIG. 2, FIG. 3 along with FIG. 4, FIG. 5 and FIG. 6, preferably, the hand guard sleeve 2 includes a plurality of first fixation holes 27 penetrating through the first guiding member 23 and the second guiding member 26 formed thereon. The first corresponding guiding member 33 of the gun barrel 3 includes a plurality of first attachment holes 331 formed thereon and corresponding to a location of each one of the first fixation holes 27 in order to secure a plurality of first fixation members 29 between each one of the first fixation holes 27 and each one of the first attachment holes 331 respectively such that the gun barrel 3 is attached onto the hand guard sleeve 2.

The hand guard sleeve 4 includes a plurality of second fixation holes 43 formed thereon and corresponding to the second corresponding guiding members 42. The hand guard sleeve 2 includes a plurality of second fixation holes 28 formed thereon and corresponding to a location of each one of the second fixation holes 43 as well as penetrating through the first guiding member 23 and the second guiding member 26 in order to secure a plurality of fixation members 44 between each one of the fixation holes 43 and each one of the second attachment holes 28 respectively such that the hand guard 4 is attached onto the hand guard sleeve 2 via a rear end of the gun barrel 3. Certainly, a plurality of third fixation members 46 can be further used in order to attach the hand guard 4 onto the end of the head portion of the gun barrel 3.

With the aforementioned structure, it is able to provide a toy gun with a facilitated assembly and a time-saving assembly method in order to complete the assembly thereof for the uses of users.

Preferably, with the consideration of the merits of reduced cost and reduced sales price for the toy gun in order to achieve the effect of increased acceptance and availability of the toy gun, the aforementioned gun frame 1, the hand guard sleeve 2, the gun barrel 3 and the hand guard 4 are all made of an industrial plastic material (such as: nylon). Therefore, the hand guard sleeve 2 can be integrally formed at the front end 11 of the gun frame 1 with ease, and the hand guard 4 thereof can be of a cylinder structure integrally formed by using the industrial plastic material. Certainly, the gun frame 1, the hand guard sleeve 2, the gun barrel 3 and the hand guard 4 can also be made of other materials not limited to the industrial plastic material only; for example, they can also be made of a metal material in order to achieve the effect of mimicking a real gun.

In view of the above, the present invention is of the following advantageous effects over the prior arts: with the design of the hand guard sleeve 2 and all of the guiding members 23, 26, 33, 42, the gun barrel 3 and the hand guard 4 can both be assembled onto the gun frame 1 via the hand guard sleeve 2 such that the effects of facilitated assembly and time-saving assembly can be achieved.

Furthermore, the present application is also of the other further advantageous effects: since the gun frame 1, hand guard sleeve 2, gun barrel 3 and the hand guard 4 are all made of an industrial plastic material, the cost and sales price of the toy gun can be reduced in order to increase the acceptance and availability of the toy gun while achieving the effects of reducing the loading of the user and maintaining the structural strength (such as the configuration of the first guiding member 23 and the first corresponding guiding member 33) of the toy gun competent to one made of a metal material.

With the design of the blocking portion 32 and the stepped height drop portion 22 in addition to that the first fixation hole 27 is designed to form on the first and second guiding members 23, 26 while the first attachment hole 331 is designed to form on the first corresponding guiding member 33, when the first corresponding guiding member 33 is slidably attached to the first guiding member 23 correspondingly, such design allows all holes to be precisely aligned in position respectively such that the first fixation members 29 can be used for securement in a swift manner.

By configuring the first guiding member 23 and the first corresponding guiding member 33 to include three members for each, the effect of fool-proof can be achieved during the time when the gun barrel 3 is inserted into the hand guard sleeve 2.

By allowing one end of the hand guard 4 to abut against the front end 11 of the gun frame 1 in addition to that the second fixation hole 43 is designed to form on the second corresponding guiding member 42 and the second attachment hole 28 is designed to form on the first and second guiding members 23, 26, when the second guiding member 26 is slidably attached to the second corresponding guiding member 42 correspondingly, such design allows all holes to be precisely aligned respectively such that the second fixation members 44 can be used for securement in a swift manner.

By providing the restricting member 321 and the notch 221 on the gun barrel 3 and the hand guard sleeve 2 respectively, there is no loose space formed between the gun barrel 3 and the hand guard sleeve 2 in order to prevent the gun barrel 3 to rotate relative to the hand guard sleeve 2; therefore, a greater assembly precision can be achieved.

It shall be noted that the above description provides preferred embodiments of the present invention only, which shall not be treated as limitation of the scope of the present invention. Any equivalent techniques and technical modifications based on the content of the specification and drawings of the present invention shall be deemed to be within the scope of the present invention.

What is claimed is:

1. A toy gun assembly structure, comprising:

a gun frame;

a hand guard sleeve connected to the gun frame and having an inner insertion portion and an outer mounting portion, one end of the hand guard sleeve facing toward a direction of another end opposite from the one end in order to define an axial direction, the inner insertion portion and the outer mounting portion respectively comprising a plurality of first guiding members and a plurality of second guiding members extended along the axial direction;

a gun barrel inserted into the inner insertion position correspondingly, an outer perimeter of the gun barrel having a plurality of first corresponding guiding members disposed thereon and slidably attached to each one of the first guiding members correspondingly; and a hand guard correspondingly mounted onto the outer mounting portion, an inner perimeter of the hand guard having a plurality of second corresponding guiding members disposed thereon and slidably attached to each one of the second guiding members correspondingly.

2. The toy gun assembly structure according to claim 1, wherein each one of the first guiding members is a plurality of guiding slots formed at the inner perimeter of the hand guard sleeve, each one of the first corresponding guiding members is a plurality of ribs protrudes out of the outer perimeter of the gun barrel, each one of the ribs is slidably attached to a location of each one of the guiding slot correspondingly.

3. The toy gun assembly structure according to claim 2, wherein the inner perimeter of the hand guard sleeve comprises a first inner perimeter and a second inner perimeter protruded out of the first inner perimeter, each one of the guiding slots is formed at the second inner perimeter.

4. The toy gun assembly structure according to claim 3, wherein a stepped height drop portion is formed between one end of the first inner perimeter and the one end of the second inner perimeter, the outer perimeter of the gun barrel includes a blocking portion protruded therefrom and corresponding to the stepped height drop portion.

5. The toy gun assembly structure according to claim 4, wherein the blocking portion includes a restricting member protruded therefrom toward an axial direction and corresponding to any one of the first corresponding guiding members, the stepped height drop portion includes a notch indented thereon toward the axial direction and corresponding to any one of the first guiding member, the restricting member is inserted into a location of the notch correspondingly.

6. The toy gun assembly structure according to claim 1, wherein the hand guard sleeve includes a plurality of first fixation holes formed thereon and penetrating through the first guiding member and the second guiding member, the first corresponding guiding member of the gun barrel includes a plurality of first attachment holes formed thereon and corresponding to a location of each one of the first fixation holes, a plurality of first fixation members are disposed between each one of first fixation holes and each one of the first attachment holes.

7. The toy gun assembly structure according to claim 1, wherein the hand guard sleeve includes a plurality of second fixation holes formed thereon and corresponding to the second corresponding guiding member, the hand guard sleeve includes a plurality of second attachment holes formed thereon and corresponding to a location of each one of the second fixation holes, as well as penetrating through the first guiding member and the second guiding member, a plurality of second fixation members are disposed between each one of second fixation holes and each one of the second attachment holes.

8. The toy gun assembly structure according to claim 1, wherein each one of the second guiding members is a plurality of ribs protruded out of the outer perimeter of the hand guard sleeve, each one of the second corresponding members is a plurality of guiding slots formed at the inner perimeter of the hand guard, each one of the ribs is slidably attached to a location of each one of the guiding slot correspondingly.

9. The toy gun assembly structure according to claim 1, wherein the gun frame, the hand guard sleeve, the gun barrel and the hand guard are all made of an industrial plastic material.

10. The toy gun assembly structure according to claim 1, wherein the hand guard is a cylinder structure integrally formed.

11. The toy gun assembly structure according to claim 1, wherein the first guiding member and the first corresponding member thereof are configured to include three members for each.

12. The toy gun assembly structure according to claim 1, wherein the gun frame, the hand guard sleeve, the gun barrel and the hand guard are all made of a metal material.

* * * * *